US008983316B2

(12) United States Patent
Mogi

(10) Patent No.: US 8,983,316 B2
(45) Date of Patent: Mar. 17, 2015

(54) FIXING DEVICE AND CONTROL DEVICE

(71) Applicant: Canon Kabushiki Kaisha, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,430

(22) Filed: Aug. 29, 2013

(65) Prior Publication Data

US 2014/0064755 A1 Mar. 6, 2014

(30) Foreign Application Priority Data

Sep. 6, 2012 (JP) ..... 2012-195672

(51) Int. Cl.
*G03G 15/00* (2006.01)
*G03G 15/20* (2006.01)
*G03G 21/16* (2006.01)

(52) U.S. Cl.
CPC ..... *G03G 15/2032* (2013.01); *G03G 15/2017* (2013.01); *G03G 21/1685* (2013.01)
USPC ..... 399/43

(58) Field of Classification Search
USPC ..... 399/43
See application file for complete search history.

(56) References Cited

U.S. PATENT DOCUMENTS

| | | | | |
|---|---|---|---|---|
| 8,554,097 | B2 | 10/2013 | Hara et al. | |
| 8,660,476 | B2 * | 2/2014 | Aoi | 399/397 |
| 2002/0044803 | A1 * | 4/2002 | Kobaru et al. | 399/323 |
| 2005/0271432 | A1 | 12/2005 | Chiba | |
| 2007/0155569 | A1 * | 7/2007 | Miyamura | 475/149 |
| 2011/0026960 | A1 * | 2/2011 | Okamoto | 399/67 |
| 2011/0188872 | A1 * | 8/2011 | Nara et al. | 399/67 |
| 2011/0268484 | A1 * | 11/2011 | Aoi | 399/397 |
| 2014/0037308 | A1 * | 2/2014 | Nawa et al. | 399/45 |
| 2014/0064787 | A1 * | 3/2014 | Mogi | 399/122 |
| 2014/0064788 | A1 * | 3/2014 | Mogi | 399/122 |

FOREIGN PATENT DOCUMENTS

JP 2005-351939 A 12/2005

* cited by examiner

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

A fixing device includes a fixing device including rollers which form a nip therebetween to fix a toner image on a sheet; a reciprocating mechanism, including a motor, for reciprocating the fixing device within a predetermined range by moving the fixing device in a longitudinal direction thereof for each passages of a predetermined number of sheets through the nip; and a controller for controlling the motor so that a drive time of the motor per the predetermined number of the sheets is longer in a first range including a point at which a moving direction of the fixing device reverses than in a second range in which the moving direction of the fixing device does not reverse.

20 Claims, 14 Drawing Sheets

FIXING DEVICE AND CONTROL DEVICE

FIELD OF THE INVENTION AND RELATED ART

The present invention relates to a fixing device and a control device for an image forming apparatus such as a copying machine, a printer, a facsimile machine or a complex machine having a plurality of functions of those machines.

In the image forming apparatus for forming an image through an electrophotographic type process, an image forming station forms a toner image, transfers the toner image onto a recording material (sheet) and fixes the toner image on the recording material by heating the recording material having the transferred toner image by a fixing device.

In such a fixing device, when the recording material is nipped by a nip, lateral edge portions (edges of widthwise ends) of recording material are in contact with a fixing member (one of rotatable members).

At this time, the surface of the fixing member tends to be damaged by the lateral edge portion of the recording material.

When such damage by the edge of recording materials having a small width occurs, the resulting unsmoothness of the surface of the fixing member appears on a large width recording material subsequently processed. Therefore, it is desired to reduce the production of the edge flaw.

In order to reduce the influence of the damage by the lateral edge, Japanese Laid-open Patent Application 2005-351939) proposes that an entirety fixing device (pair of rotatable members) is reciprocated in the widthwise direction of recording material.

However, with such a structure, the reciprocating operation may not be properly carried out due to the play or the like in the reciprocation mechanism when the moving direction of the fixing device switches. If this occurs, the fixing device remains at the same position with the result that the reduction of the edge flaw is insufficient.

SUMMARY OF THE INVENTION

According to an aspect of the present invention, there is provided a fixing device comprising: a fixing device including a pair of rotatable members which form a nip therebetween to fix a toner image on a sheet; a reciprocating mechanism, including a motor, configured to reciprocate the fixing device within a predetermined range by moving the fixing device in a longitudinal direction thereof for each passage of a predetermined number of sheets through the nip; and a controller configured to control the motor so that a drive time of the motor per the predetermined number of the sheets is longer in a first range including a point at which a moving direction of the fixing device reverses than in a second range in which the moving direction of the fixing device does not reverse.

These and other objects, features, and advantages of the present invention will become more apparent upon consideration of the following DESCRIPTION OF THE EMBODIMENTS of the present invention, taken in conjunction with the accompanying drawings.

DESCRIPTION OF THE EMBODIMENTS

Figure 1:
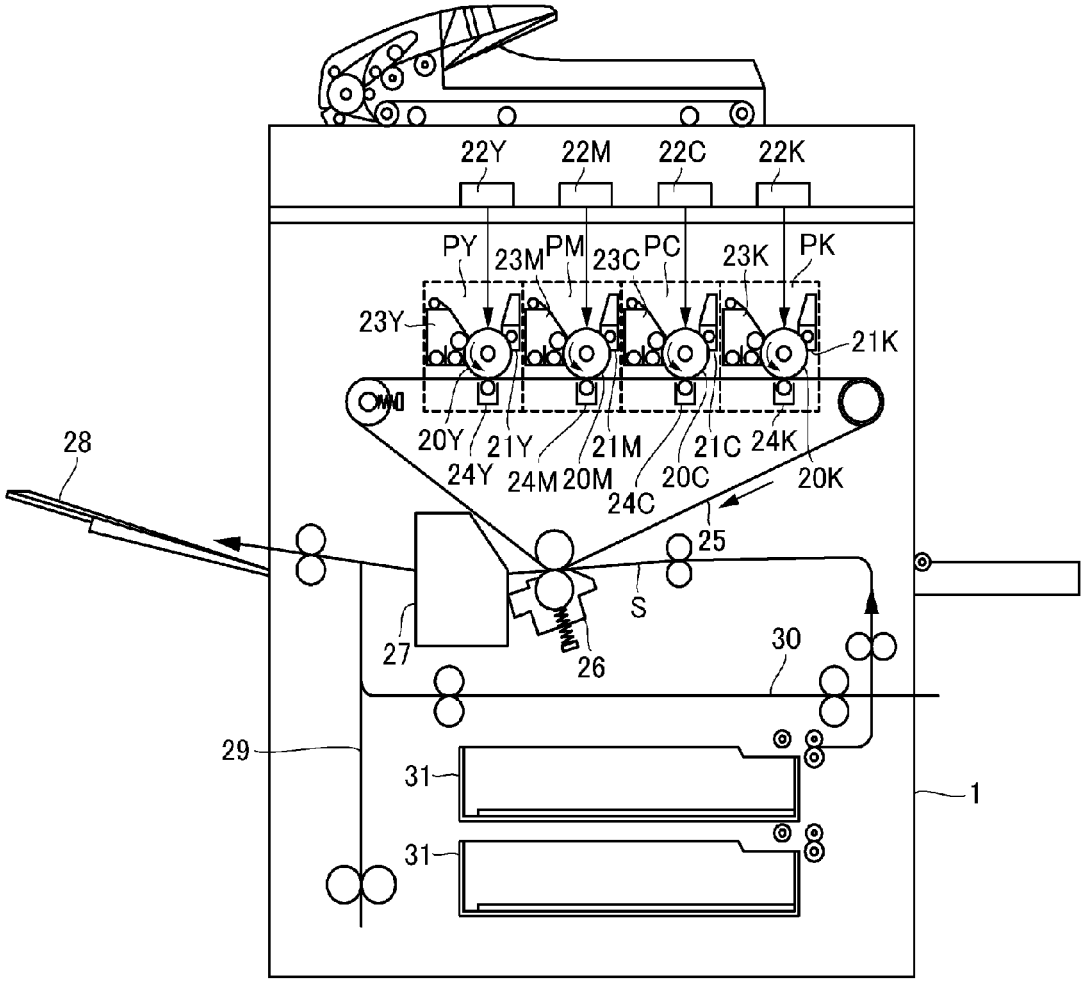
FIG. 1 is a schematic sectional view of an image forming apparatus.

Referring to FIG. 1 to FIG. 14, an embodiment of the present invention will be described. Referring to FIG. 1, an image forming apparatus according to this embodiment will be described.

[Image Forming Apparatus]

The image forming apparatus 1 comprises a fixing device 27 as an image heating apparatus which fixes an unfixed image transferred onto a recording material (sheet) S such as paper by applying heat and pressure. In this embodiment, the image forming apparatus is of a full-color and intermediary transfer type, but the present invention is applicable to another type image forming apparatus comprising an image heating device.

The image forming apparatus 1 is tandem type in which image forming stations PY, PM, PC, PK for forming Y (yellow), M (magenta), C (cyan), K (black) toner images, respectively are provided. The image forming stations PY, PM, PC, PK are arranged along a rotational moving direction of an intermediary transfer belt 25 as an intermediary transfer member and carry out the toner image the processes for the respective colors in parallel.

The image forming stations have fundamentally the same structures, and therefore, the following description of the image forming stations applies commonly to them, although suffixes Y, M, C and K are added in the drawings and only when necessary.

The image forming station P includes a photosensitive drum 20 as an image bearing member on which a toner image is formed and carried. Around the photosensitive drum 20, there are provided a charging device 21, a developing device 23, a primary transferring device 24 (unshown) and a cleaner. Above the image forming apparatus 1, an exposure device 22 (22Y, 22M, 22C, and 22K) is provided.

Photosensitive drum 20 is rotated in the direction indicated by the arrow in FIG. 1, during which a surface of the photosensitive drum 20 is uniformly charged to a predetermined potential by the charging device 21. Thereafter, the charged surface of the photosensitive drum 20 is exposed by the exposure device 22 so that an electrostatic latent image is formed on the photosensitive drum 20. The electrostatic latent image on the photosensitive drum 20 is developed with a developer by the developing device 23 into a visualized toner image.

The toner image formed by the developing device 20 is primary-transferred superposingly on an endless intermediary transfer belt 25 from the photosensitive drum 20 by a primary transferring device 24. The toner images above intermediary transfer belt 25 are secondary-transferred all together onto the recording material S by a secondary transfer device 26. The surface of the photosensitive drum 20 after the primary transfer and the surface of the intermediary transfer belt 25 after the secondary transfer are cleaned by the cleaner (unshown) to be prepared for the next image formation.

The recording material S is fed to a secondary transfer portion comprising a secondary transfer device 26 and the intermediary transfer belt 25, by a feeding means such as a feeding roller, from a sheet feeding cassette 31. After the secondary transfer, the recording material S carrying the toner image is fed to the fixing device 27. The fixing device 27 heats and presses the unfixed toner image to melt and soften it, thus fixing it on the recording material S. The recording material S having the fixed toner image is discharged to a sheet discharge tray 28. When an image is to be formed also on the back side of the recording material S, the recording material S is reversed by a recording material reversing path 29 and is refed to the secondary transfer portion along the duplex print feeding path 30, where it receives the side on the back side.

As described in the foregoing, a series of image forming process operations including the charging, the exposure, the development, the transfer and the fixing is executed to form the image on the recording material S. If the image forming apparatus is a monochromatic image forming apparatus, only a black image forming station is provided. The structures and the order of the Y, M, C, K image forming stations are not limited to those described above.

[Fixing Device]

Figure 2:
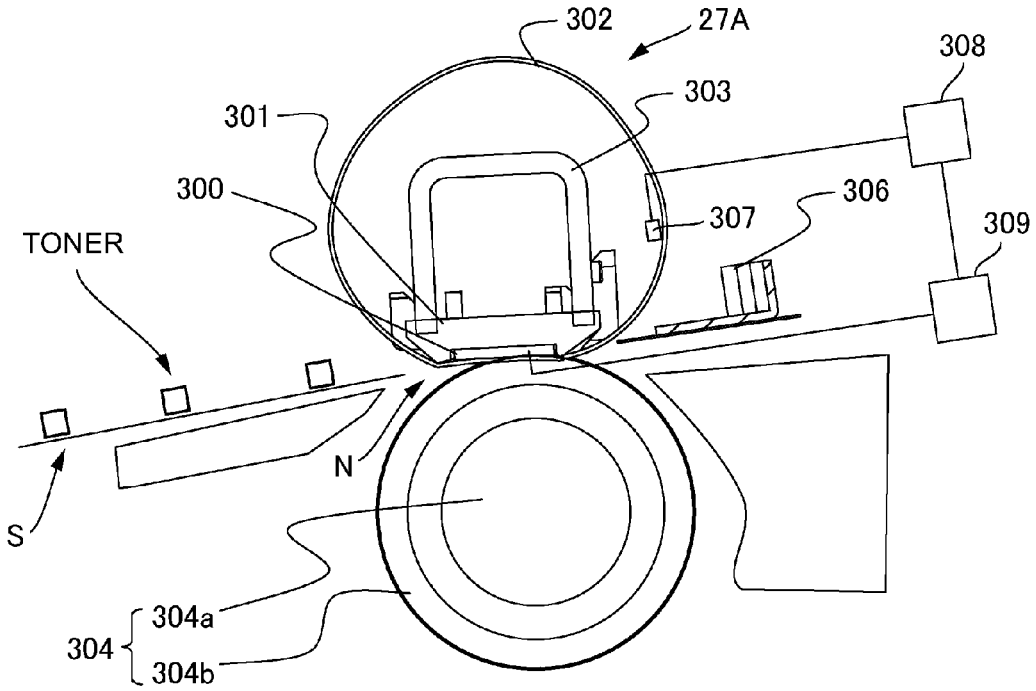
FIG. 2 is a schematic sectional view of a heating unit of a fixing device.

Referring to FIG. 2 through FIG. 5, the fixing device 27 and a heating unit 27A (fixing device) of the fixing device 27 according to this embodiment will be described. As shown in FIG. 2, the heating unit 27A comprises an endless heating belt (first rotatable member) 302 as a rotatable heating member, and a pressing roller (second rotatable member) 304 as a pressing rotatable member forming a nip N between an outer peripheral surface of the heating belt 302 and the heating belt 302. The pressing roller 304 has a function also as a driving roller (driving rotatable member) for rotating the heating belt 302 as will be described hereinafter. Inside the heating belt 302, there is provided a heater (ceramic heater) 300 as a heating mechanism.

The heater 300 comprises an elongated thin-plate-like ceramic substrate elongated in a perpendicular direction to the sheet of the drawing of FIG. 1 (front and back direction), and a heat generating resistor layer provided on the surface of the substrate, as basic elements. Such a heater 300 is a low thermal capacity heater which is heated steeply by the electric power supply from a voltage source 309 to the heat generating resistor layer.

The heater 300 is fixed to a heater holder 301 as a supporting member. The heater holder 301 has a trough like shape having a substantially half-arc cross-section and is a heat insulation member composed of heat resistive resin material or the like elongated in the direction perpendicular to the sheet of the drawing of FIG. 1. The heater 300 is fitted into a groove portion formed in the lower surface of heater holder 301 along the length thereof and is fixed by a heat resistive adhesive, with the heater surface side facing downward. Designated by 303 is a stay provided inside of heater holder 301 to support the heater holder 301.

The heating belt 302 is made of a heat resistive film, for example, and is loosely fitted around the heater holder 301 including the heater 300. The heating belt 302 has a composite layer in order to improve a quick start property thereof by reducing the thermal capacity as follows. The belt comprises a base layer of metal such as SUS or Ni, having a film thickness of not more than 100 μm, preferably 20-50 μm. The outer peripheral surface thereof is coated with a heat resistive rubber such as silicone rubber or fluorine-containing rubber, or an elastic layer of a foam member of silicone rubber. The outer peripheral surface thereof is further coated with PTFE, PFA or the like layer having a thickness of approx. 5-50 μm. An inner surface of the base layer is provided with a protection layer of PI (polyimide) or the like having a thickness of several μm to reduce a sliding friction between the heater 300 and the metal layer of the heating belt 302.

The pressing roller 304 comprises a metal core 304*a*, and an elastic layer 304*b* composed of heat resistive rubber such as silicone rubber or fluorine-containing rubber or a foam member of silicone rubber, and the opposite end portions of the metal core 304*a* are rotatably supported by side plates 400, 401. As shown in FIG. 2, above the top side of the pressing roller 304, the heater 300, the heater holder 301, the heating belt 302 and an assembly of the stay 303 are provided, extending in parallel with the pressing roller 304 with the heater 300 side facing downward. The stay 303 is urged toward the pressing roller 304 by a variable pressure mechanism 500, which will be described hereinafter. By this, the lower surface (FIG. 2) of the heater 300 is press-contacted toward the outer peripheral surface of pressing roller 304 through the heating belt 302 against the elastic of the elastic layer 304*b* to form a nip N having a predetermined width.

A temperature of the heating belt 302 is monitored by a thermistor 307 as a temperature detecting means outputting a detection signal to a controller (CPU) 308 of the control device. The controller 308 adjusts a current applied to the heater 300 by the voltage source 309 on the basis of the signal of the thermistor 307, so that the heating belt 302 keeps a predetermined target temperature during the fixing operation.

In the state that the temperature of the heating belt 302 is controlled, the recording material carrying the toner image is fed into the nip N, and the unfixed toner image is heated and pressed so that the toner image is fixed on the recording material. The recording material after the fixing is separated from the heating belt 302, and is discharged from the nip N along a separation guide 306 provided downstream of the nip N in the feeding direction. The separation guide 306 is disposed to be spaced from the heating belt 302 so that the recording material discharged from the nip N is not wrapped around the heating belt 302 and so that the heating belt 302 is not damaged. Such a separation guide 306 is engaged with a part of a flange 305 which will be described hereinafter, and is fixed by an urging means such as a spring.

Figure 3:
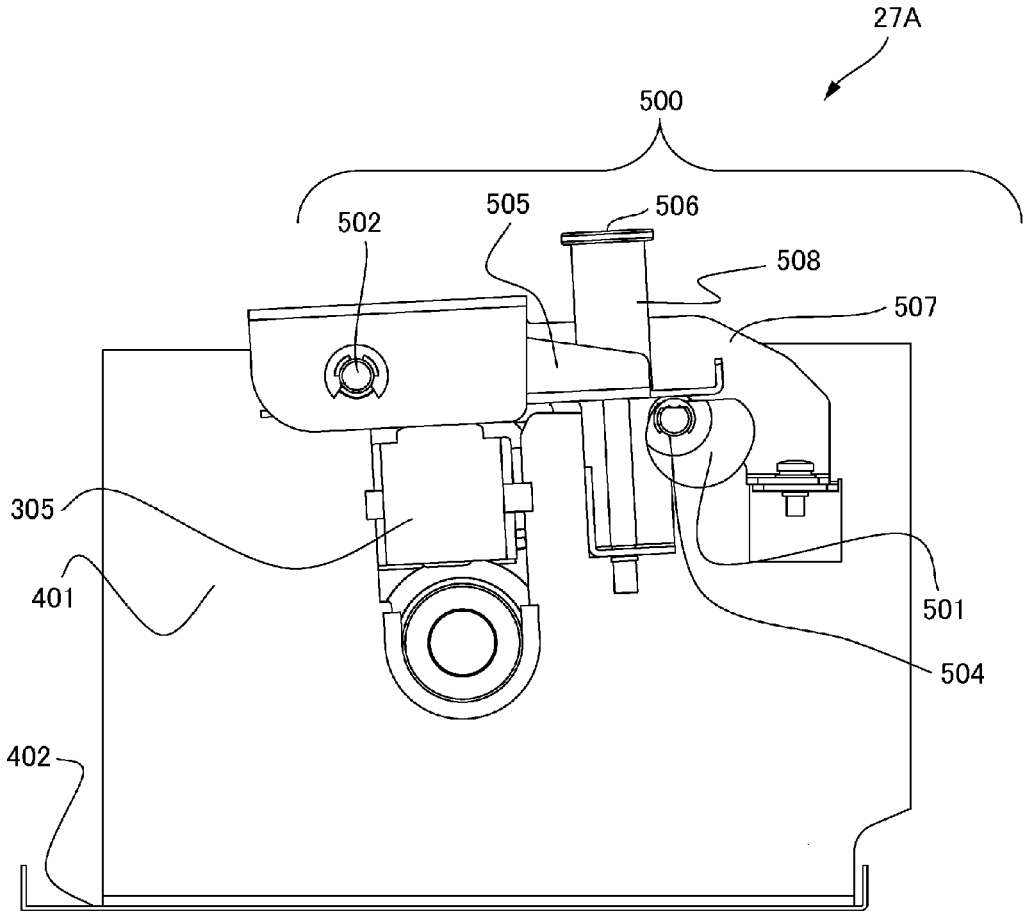
FIG. 3 is a schematic side view of a heating unit of the fixing device.
Figure 4:
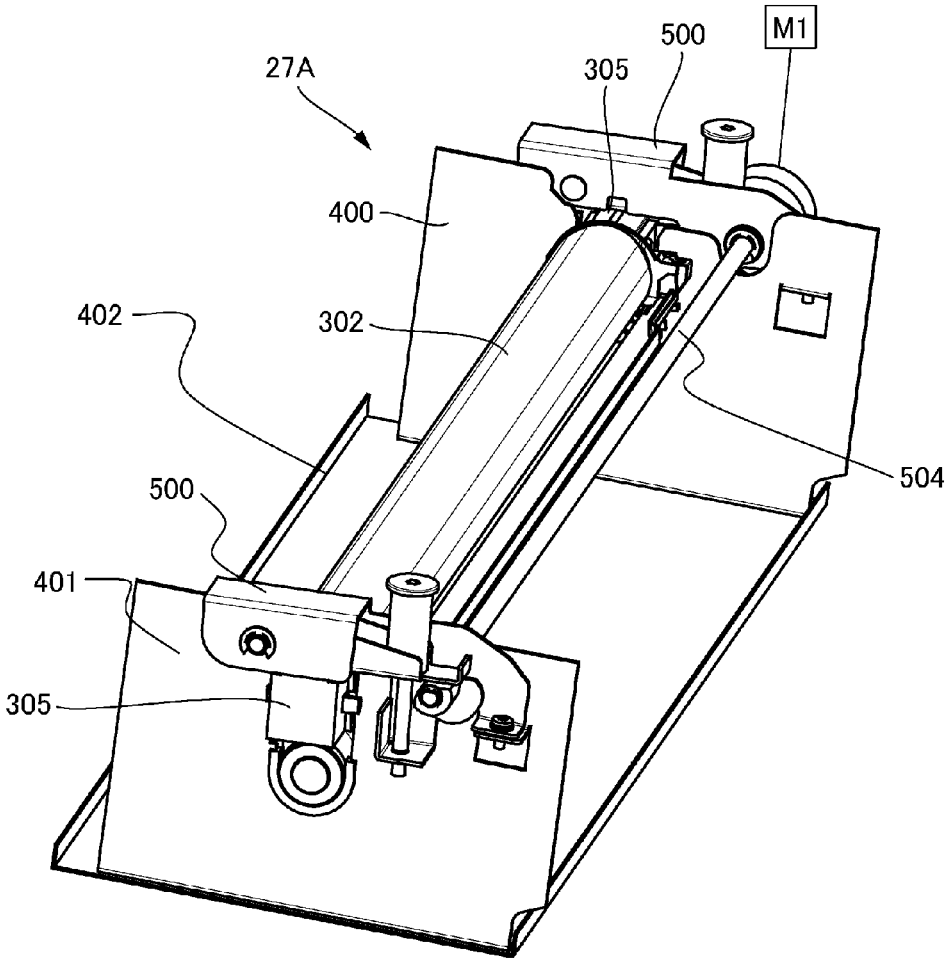
FIG. 4 is a schematic perspective view of a heating unit of the fixing device.

The flange 305 is supported by the side plates 400 and 401 constituting a frame (case) of the heating unit 27A as shown in FIGS. 3 and 4, and is movable toward and away from the pressing roller 304. The flange 305 is provided with a regulating member for supporting opposite end portions (rotation axial direction of the heating belt 302) of stay 303 and the heater holder 301 and for regulating a configuration in the circumferential direction and a movement in the longitudinal direction of the heating belt 302.

The heating belt 302 supported by such a flange 305 is urged toward the pressing roller 304 by the variable pressure mechanism 500 shown in FIGS. 3 and 4. The variable pressure mechanism 500 is provided at each of the opposite ends of the heating belt 302, and comprises a pressing cam 501, a pressing member rotational shaft 502, a pressing cam rotational shaft 504, a pressing member 505, a pressing adjusting screw 506, pressing supporting plate 507 and an urging spring 508.

The pressing member 505 and the pressing supporting plate 507 are supported by the side plates 400, 401 through the pressing member rotational shaft 502, and the pressing member 505 can move rotatably relative to the pressing supporting plate 507. The pressing supporting plate 507 is fixed to the side plates 400, 401. To the pressing supporting plate 507, the pressing adjusting screw 506 is fastened, and by rotating the pressing adjusting screw 506, a seat of the pressing adjusting screw 506 contracts the spring of the urging spring 508 to increase the spring load applied to the pressing member 505. The pressing member 505 is rotatably supported relative to the pressing supporting plate 507 as described above, and therefore, the compressive force of the urging spring 508 produces a moment about the pressing member rotational shaft 502.

The pressing member 505 is contacted to the flange 305. Therefore, the moment produced in the pressing member 505 pushes the flange 305 toward the pressing roller 304 to form the above-described nip N between the pressing roller 304 and the heating belt 302.

In order to release the pressure, the pressing cam 501 eccentric by a predetermined amount is rotated to push the pressing member 505 up. The pressure is released by rotating the pressing cam 501 until the pressing member 505 and the flange 305 becomes non-contacted relative to each other. The pressing cam 501 is rotated by a motor M1 as a driving source. The pressing cams 501 are provided at the opposite sides of the fixing belt 302 and are fixed to the opposite end portions of the pressing cam rotational shaft 504 with the same phase, so that they are rotated with the same phase by the motor M1. By this, the variable pressure mechanisms 500 at the opposite sides of heating belt 302 can be actuated to switch between the pressing and releasing states to the pressing roller 304. The normal pressure is 300N, for example.

When the image forming operation starts, the variable pressure mechanisms 500 press-contact the heating belt 302 to the pressing roller 304 to form the nip N. On the other hand, when the image forming operation is finished, the variable pressure mechanisms 500 releases the heating belt 302 from the pressing roller 304, and the released state is kept.

Figure 5:
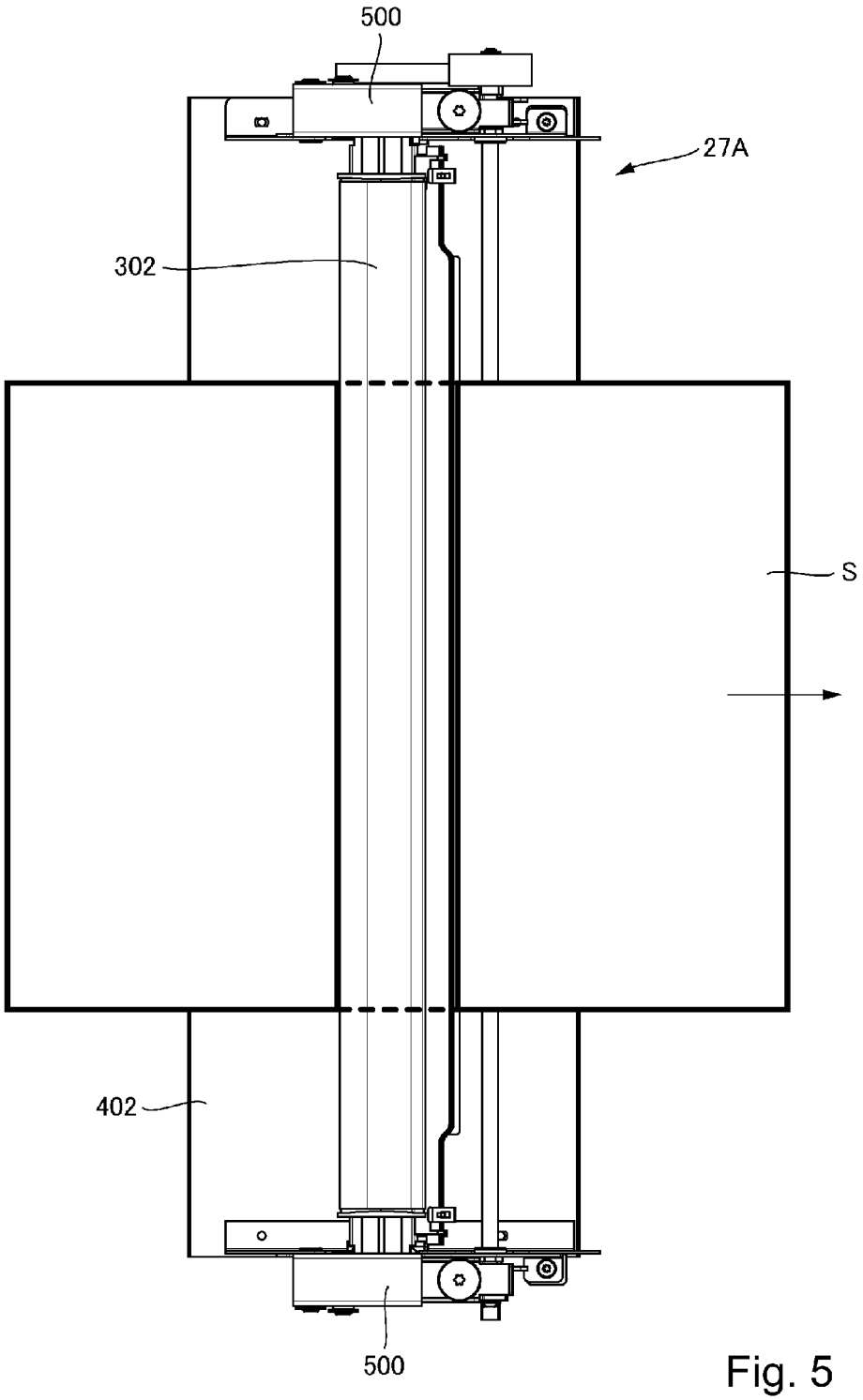
FIG. 5 is a schematic top plan view of the fixing device in which the recording material is passing the nip.

FIG. 5 shows the fixing device during the image forming operation. During the image forming operation, the nip N is formed between the heating belt 302 and the pressing roller 304 by the variable pressure mechanisms 500, and the fixing step (fixing process) is completed by passing the recording material through the nip N. The edges of the recording material have small burrs produced by cutting, and the burrs produce a flaw surface of the heating belt 302 during the fixing step at the position corresponding to the edges of the recording material, and the flaws may appear on the prints.

When the recording materials of the same size are continuously processed, a temperature difference occurs between the recording material passing portion of the surface of the heating belt 302 and the non-passing portion of the surface of the heating belt 302 because the heat of heating belt 302 is consumed for the toner fixing in the passing portion, but it is not consumed in the non-passing portion. By the temperature difference, a surface speed of the heating belt 302 is higher in the non-passing portion region than in the passing portion region with the result of slippage in the lateral end portions of the recording material. Therefore, the surface of the heating belt 302 results in having fine unsmoothness (fine pits and projections, damage by the lateral edges or edge flaw).

[Reciprocating Mechanism]

Figure 6:
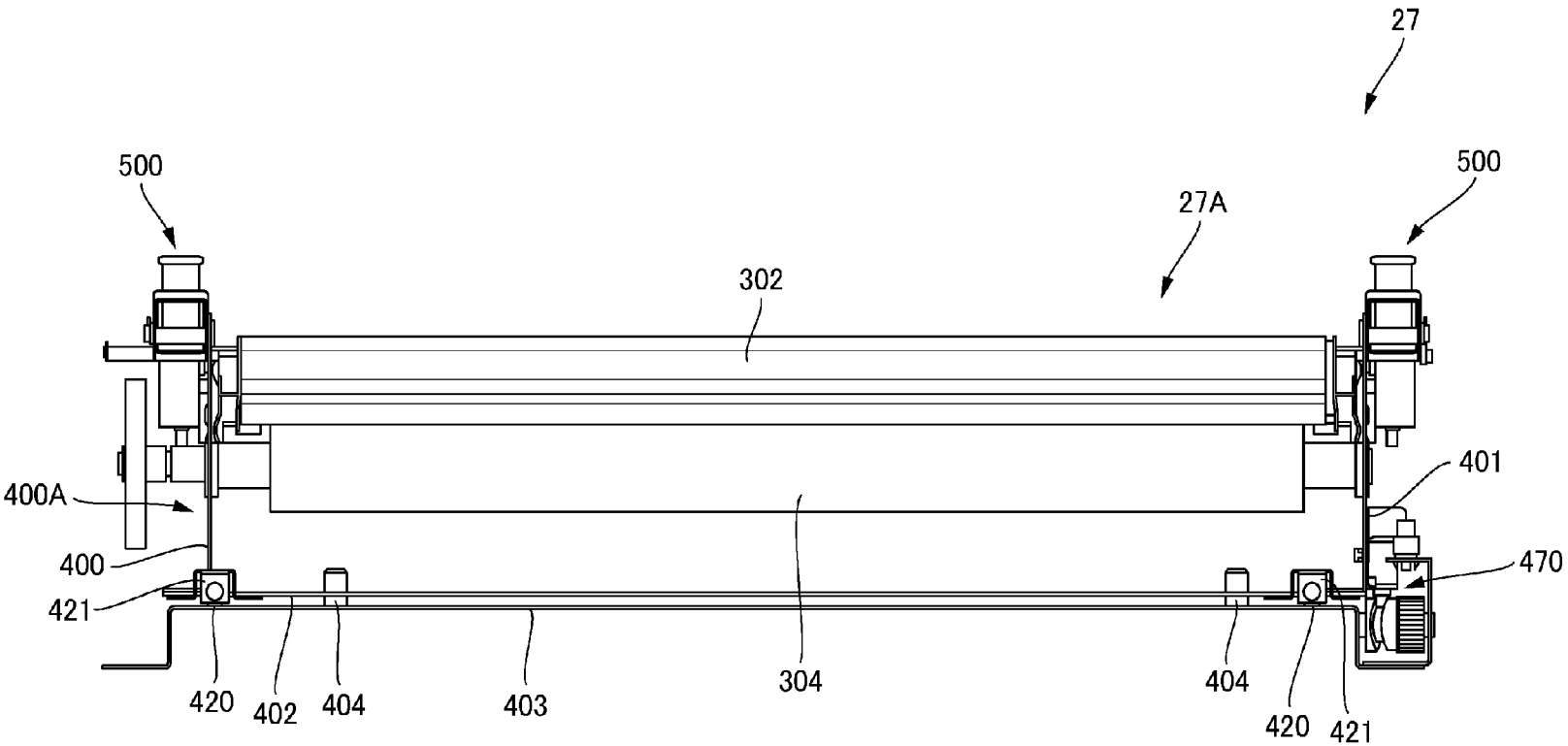
FIG. 6 is a schematic front view of the fixing device.
Figure 7:
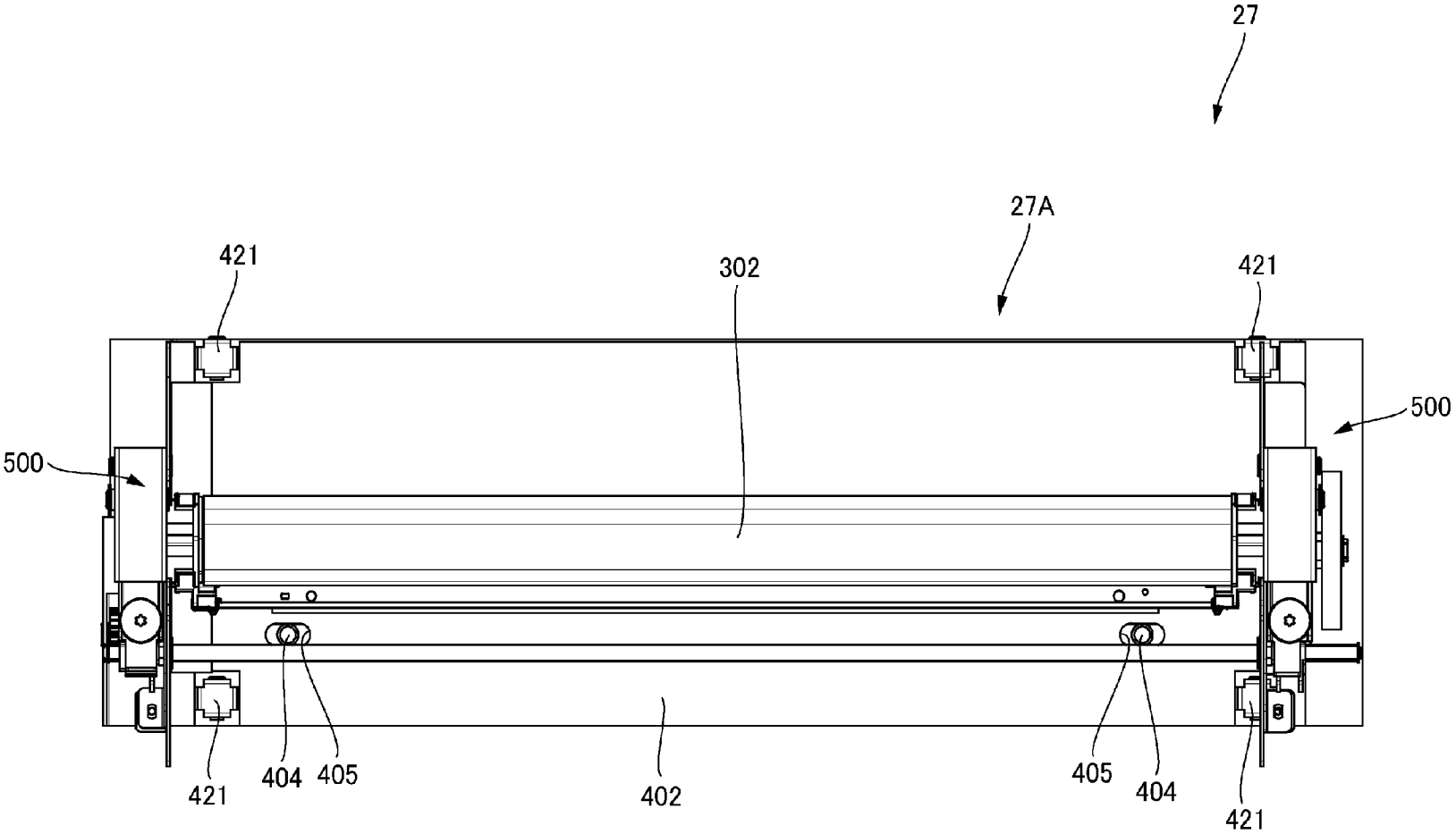
FIG. 7 is a schematic top plan view of the fixing device.
Figure 8:
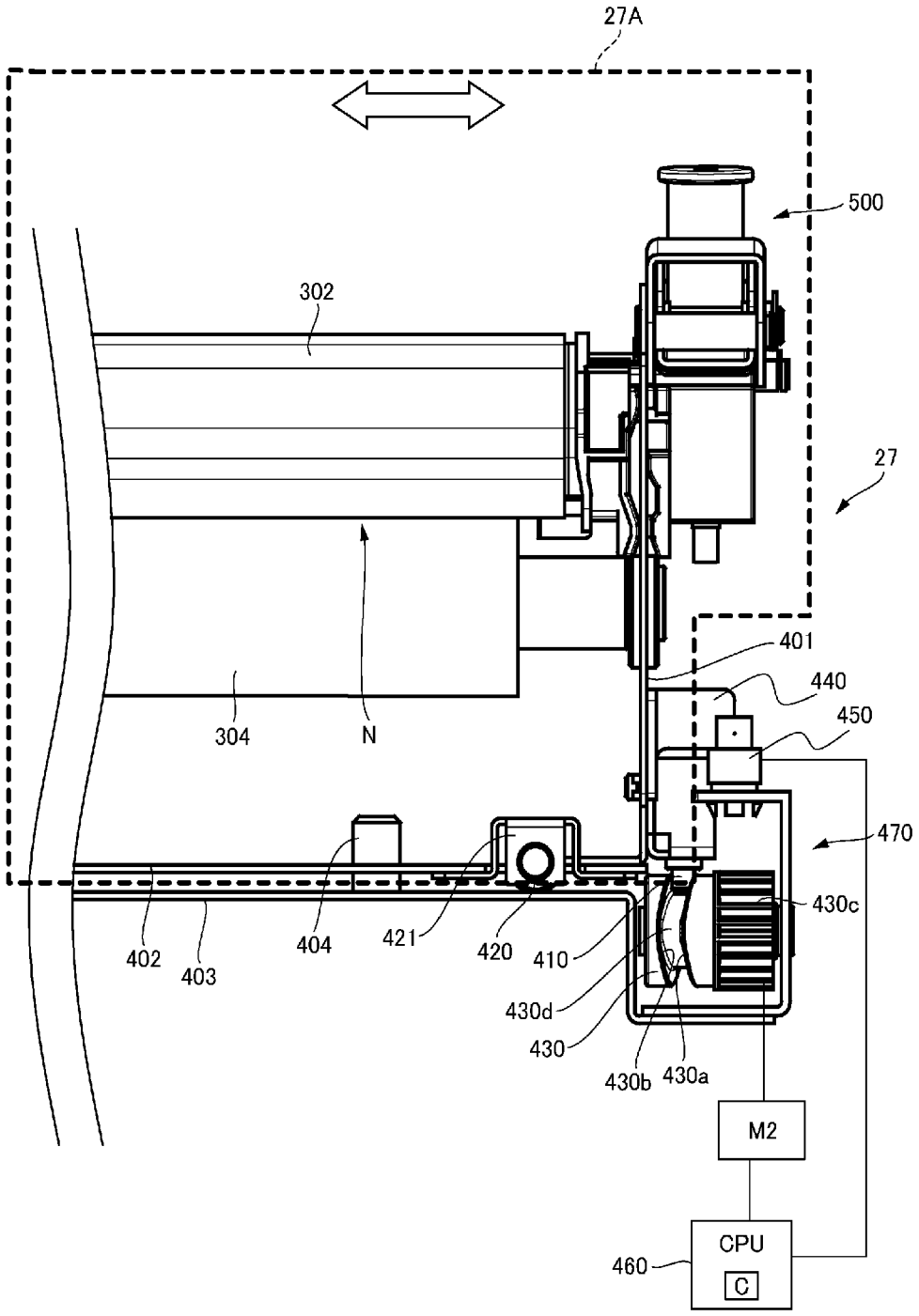
FIG. 8 is a view of a right-hand end portion of FIG. 6.

In this embodiment, in order to reduce such edge flaws, the reciprocation base plate, which is a supporting portion for the heating unit 27A, is reciprocated in the longitudinal direction (widthwise direction of the recording material or direction perpendicular to the feeding direction of recording material). Referring to FIG. 6 through FIG. 8, a reciprocating mechanism for reciprocating operation will be described.

As shown in FIGS. 6 and 7, the heating unit 27A of the fixing device 27 includes a frame 400A having the front side plate 400, the rear side plate 401 and a bottom plate 402. Thus, the heating belt 302 and the pressing roller 304 including the assembly such as the heater 300 are supported by the frame 400A. In this embodiment, the front side and the rear side are based on the installed state of the image forming apparatus, and the front side is the side where the user operates the image forming apparatus, and the rear side is the opposite side.

At each of four corners of the bottom plate of the frame 400A, a roller 420 is rotatably provided using a bearing 421, and the surface of the roller 420 is slightly projected downwardly beyond the bottom plate 402. In addition, the bottom plate 402 is provided with two elongated holes 405 extending in the widthwise direction (longitudinal direction, left-right direction of FIG. 6 through FIG. 8) as an engaged portion, the elongated holes 405 being spaced from each other and being provided at a sheet discharging side.

The frame 400A of such a heating unit 27A is a part of the fixing device 27, and is carried by the reciprocation base plate 403 movably in the widthwise direction relative the main assembly of the image forming apparatus. More particularly, by the rollers 420 provided in the bottom plate 402 rolls on the base plate 403, the frame 400A and the heating unit 27A can move in the widthwise direction relative to the base plate 403. In this manner, the bottom plate 402 is supported by the rollers 420 on the base plate 403, and therefore, the rollers 420 rotate at the time of reciprocation in which the sliding resistance is minimized.

The reciprocation base plate 403 is provided with two shafts 404 as an engaging portion in the sheet discharging side so as to engage with the elongated holes 405 of the bottom plate 402, respectively. Therefore, the frame 400A is guided in the widthwise direction by the engagement between the shaft 404 and the elongated hole 405. A movement distance in the widthwise direction is regulated by the length of the elongated hole 405 measured in the widthwise direction.

A reciprocating mechanism 470 controls the reciprocal moving operation. Referring to FIG. 8, the reciprocating mechanism 470 will be described. The reciprocating mechanism 470 is disposed at the side plate 401 side in the rear side of the fixing device 27. More specifically, the reciprocating mechanism 470 includes a reciprocating cam 430 as an inclination member, a reciprocating shaft 410 as an engageable member, and a motor M2 as driving means (operating device).

The reciprocating cam 430 is provided on one of the heating unit 27A and the supporting portion, more particularly on the base plate 403 which is a supporting portion in this embodiment, and is provided with a pair of inclined surfaces 430*a*, 430*b* inclined relative to the widthwise direction. The cam 430 has a substantially cylindrical shape and is integral with the gear 430*c* to which a rotational force is applied from the motor M2, and it is provided with V-like grooves 430*d* as seen from a diametrically outside over the entire cylindrical outer peripheral surface. Opposite side surfaces of the groove 430*d* constitute the inclined surfaces 430*a*, 430*b*, respectively. The inclined surfaces 430*a*, 430*b* extend in parallel with each other, and are waved at regular intervals when they are expanded.

Reciprocating shaft 410 is provided on the other of the heating unit 27A and the supporting portion, more particularly on the side plate 401 of the heating unit 27A in this embodiment, and is engaged with the inclined surfaces 430*a*, 430*b* of the reciprocating cam 430. That is, the reciprocating shaft 410 is inserted into the groove 430*d* of reciprocating cam 430, and the outer peripheral surface of the shaft 410 is contacted to at least one of the inclined surfaces 430*a*, 430*d*.

The motor M2 causes a relative movement between the reciprocating cam 430 and the reciprocating shaft 410 to reciprocate the heating unit 27A through the engagement between the shaft 410 and the inclined surfaces 430*a*, 430*b*. In this embodiment, the motor M2 is a pulse motor, and is driven in accordance with a pulse number fed from the controller (CPU) 460 of the control device so as to rotate the reciprocating cam 430 through an amount (angle) corresponding to the pulse number. The controller 460 may be common with the above-described controller 308 for controlling the electric power supply to the heater 300.

By the relative rotation of the reciprocating cam 430 relative to the reciprocating shaft 410, the engaging position between the reciprocating shaft 410 and the inclined surfaces 430*a*, 430*b* changes. Since the inclined surfaces 430*a*, 430*b* are inclined relative to the widthwise direction as described above, the changing of the engaging position moves the shaft 410, and therefore the heating unit 27A fixed to the shaft 410, in the widthwise direction. Here, the heating unit 27A is movable only in the direction along the elongated hole 405 of the bottom plate 402 as described hereinbefore, and therefore, the heating unit 27A defined by broken lines in FIG. 8 moves only in the widthwise direction.

In addition, the pair of inclined surfaces 430*a*, 430*b* is in the form of a wave continuously extending in the circumferential direction as described above, and therefore, the rotation of the reciprocating cam 430 reciprocates the reciprocating shaft 410 in the widthwise direction along the wave shape. With such a structure of this embodiment, the reciprocation moving operation of the heating unit 27A is carried out.

The reciprocating cam 430 as the inclination member may be provided on the heating unit 27A side, and the shaft 410 as the engageable member may be provided on the base plate 403 side (supporting portion).

In addition, in this embodiment, there is provided a position sensor 450 as a position detecting means for detecting a position of the heating unit 27A with respect to the widthwise direction. The position sensor 450 is fixed on the base plate 403 and includes a light emitting portion and a light receiving portion for receiving the light emitted by the light emitting portion, the light emitting portion and the light receiving portion being disposed opposed to each other. In addition, a sensor flag 440 is provided on the rear side plate 401 of heating unit 27A. The sensor flag 440 enters between the light emitting portion and the light receiving portion of the position sensor 450 to block the light from the light emitting portion, by which the position sensor 450 detects a predetermined position of heating unit 27A with respect to the widthwise direction. The detection signal is fed to the controller 460, and the controller 460 controls the motor M2 on the basis of the signal.

Figure 9:
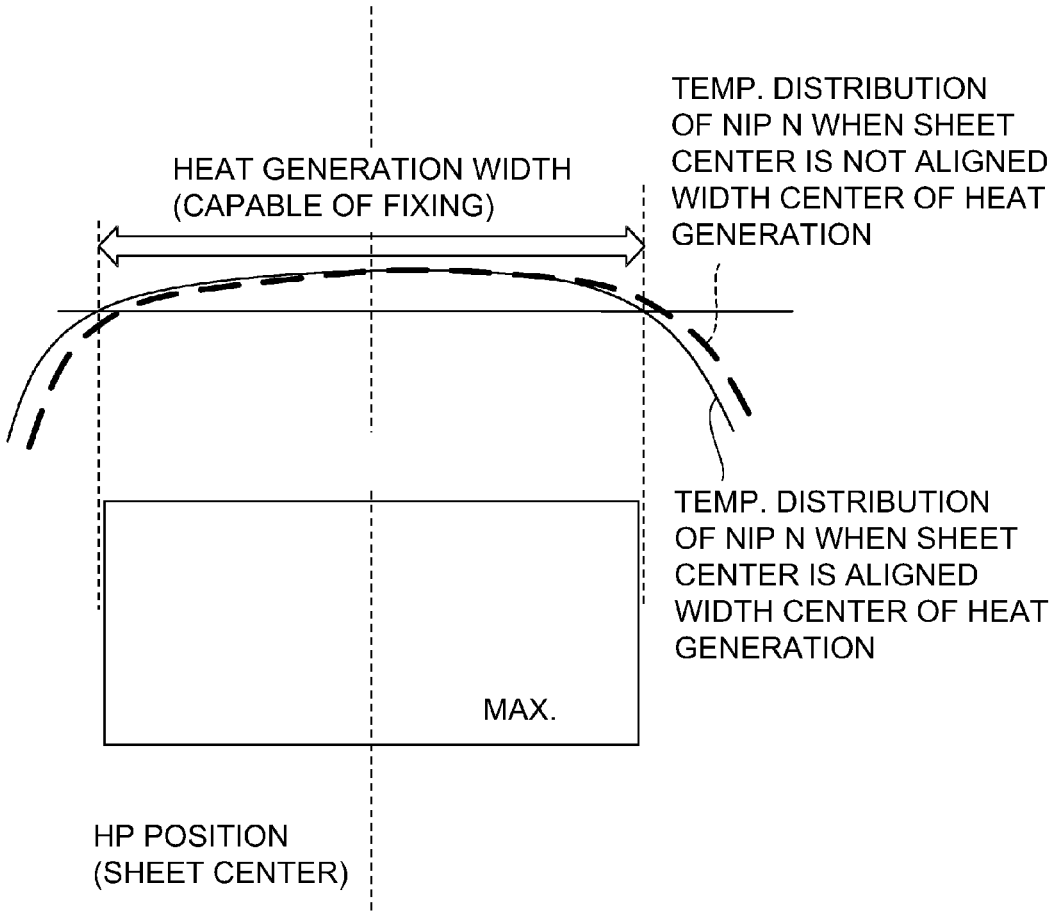
FIG. 9 is a schematic view illustrating a relation between a width of a heat generation and a maximum width size of the recording material.

In this embodiment, a home position (HP position) is the position at which the sensor flag 440 just blocks the light of position sensor 450 by the movement of the heating unit 27A from a position not blocking the light of the position sensor 450. In position HP, a widthwise center portion of recording material entering the nip N and a widthwise center portion of the heat generation width of heating belt 302 (widthwise center portion of heating region) are substantially aligned with each other. Therefore, as shown in FIG. 9, when the maximum size recording material is passed through the nip N, the heating unit 27A is moved to the HP position, by which the center portion of the heat generation width and the center portion of the recording material of the maximum size can be aligned with each other.

In this embodiment, the relation between the sensor flag 440 and the position sensor 450 is set in such a manner, and therefore, the heat generation width of the heating belt 302 can be reduced. That is, when the center portion of the maximum size recording material and the center portion of the heat generation width are deviated from each other, it is necessary to make the heat generation width larger than the heating region of the maximum size recording material by the amount of the deviation in order to cover the maximum size recording material. On the other hand, by aligning the center portion of the maximum size recording material with the center portion of the heat generation width, the heat generation width may be the same as the heating region for the maximum size recording material, and therefore, there is no necessity for making the heat generation width large.

In this manner, in this embodiment, the reciprocating shaft 410 is engaged with the groove 430*d* formed in the reciprocating cam 430, and the reciprocating cam 430 is rotated so that the reciprocation moving operation of heating unit 27A is effected. It is unnecessary to employ an urging means such as spring to urge the cam 430 to the cam surface, and therefore, the required torque can be reduced. By this, the driving structure can be downsized, and therefore, the space required by the reciprocating mechanism can be reduced.

Such a reciprocation control (reciprocation moving operation) is carried out for each recording material. That is, the controller 460 moves the heating unit 27A through a predetermined amount for each passage of the recording material through the nip N. In this embodiment, the heating unit 27A is moved during the recording material passing through the nip N after the trailing edge of recording material depart the secondary transfer portion.

The frequency of the reciprocation moving operations may be one for each sheet, of one for every 2, 3 sheets, or another plurality of sheets. The heating unit 27A is moved at every predetermined number of sheets passing the nip N. The predetermined number of sheets may be constant, or may be variable depending on the kind, the size of recording material, the number of the processed sheets or the like. The predetermined numbers may include different numbers in mixture. For example, the numbers may be, one, two, one, two, or the like.

In this embodiment, the inclination angle of inclined surfaces 430*a*, 430*b* of cam 430 is selected such that the movement distance per one recording material is 0.15 mm in the range other than the moving direction switching range of the heating unit 27A. The range of reciprocation control (reciprocation moving operation) is approx. 4-5 mm, for example. In other words, the heating unit 27A movement is by an increment of 0.15 mm within the movement range of approx. 4-5 mm. In the case that the image is to be formed on each of the sides of the recording material, it is desired that the difference between a marginal blank range of the front side in the widthwise direction of the recording material and the marginal blank range of the back side is within a limitation. However, if the movement distance of the reciprocation of the heating unit 27A by the reciprocating operation is too large, the different may not be within the limit. In order to make the different fall within the limit, the movement distance in one way of the reciprocation is preferably not more than 0.3 mm. On the other hand, if the movement distance is too small, the deviation between the center position of the sheet and the center position of the heat generation width may be kept for a long term, with the result of excessive temperature rise in the non-passing region. The temperature rise (temperature ripple) in the non-passing region is desirably within approx. 5 degree C. To make the temperature ripple not more than 5 degree C., the movement distance per recording material is preferably not less than 0.04 mm on the average.

The timing of the execution of the reciprocation moving operation is in the period in which no recording material is in the nip N, that is, so-called sheet interval, but in this embodiment, the timing is selected as described above. More particularly, it is after the trailing edge of recording material departs the secondary transfer portion, before the leading end reaches the nip N and during the period in which the recording material is nipped only by the nip N. This is because the reciprocation control (reciprocation moving operation) during a sheet interval may result in the reduction of the productivity. In addition, if the heating unit 27A carries out the reciprocating operation while the recording material is nipped by the secondary transfer portion and the nip N of the heating unit 27A, the nip N deviates the recording material in the widthwise direction with the result of a transfer defect. Therefore, in this embodiment, the timing of the execution of the reciprocating operation is selected as described above.

[Speed-Up Control at the End Portion of the Reciprocation]

In this manner, in this embodiment, the reciprocating shaft 410 is engaged with the groove 430*d* formed in the reciprocating cam 430, and the reciprocating cam 430 is rotated so that the reciprocation moving operation of heating unit 27A is effected. Therefore, the reciprocation moving operation may stagnate when the moving direction of the heating unit 27A switches, due to a gap (play) between the reciprocating shaft 410 and the groove 430*d* of the reciprocating cam 430 or the like. Here, a predetermined range including the region where the moving direction of the heating unit 27A switches is called reciprocation end portion. In this embodiment, the moving speed of the heating unit 27A is increased at the reciprocation end portion (reciprocation end portion speed-up control).

Figure 10:
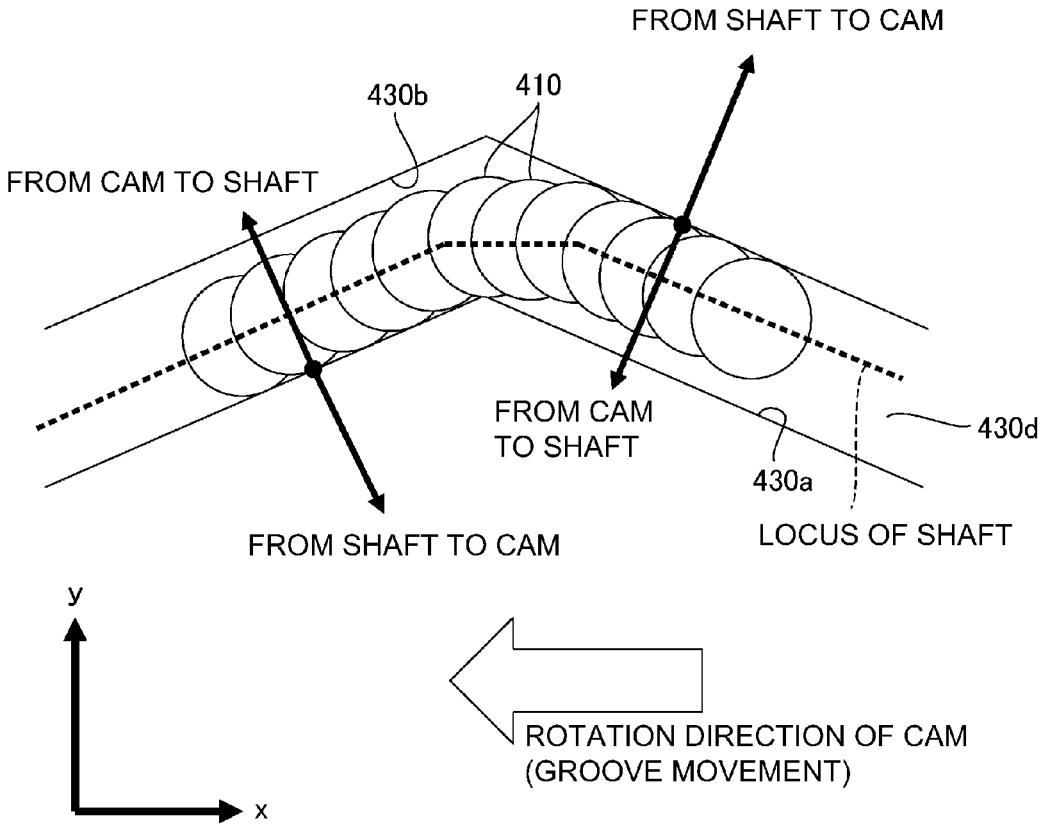
FIG. 10 is a schematic view illustrating an operation at the time when the moving direction of the reciprocating mechanism switches.
Figure 11:
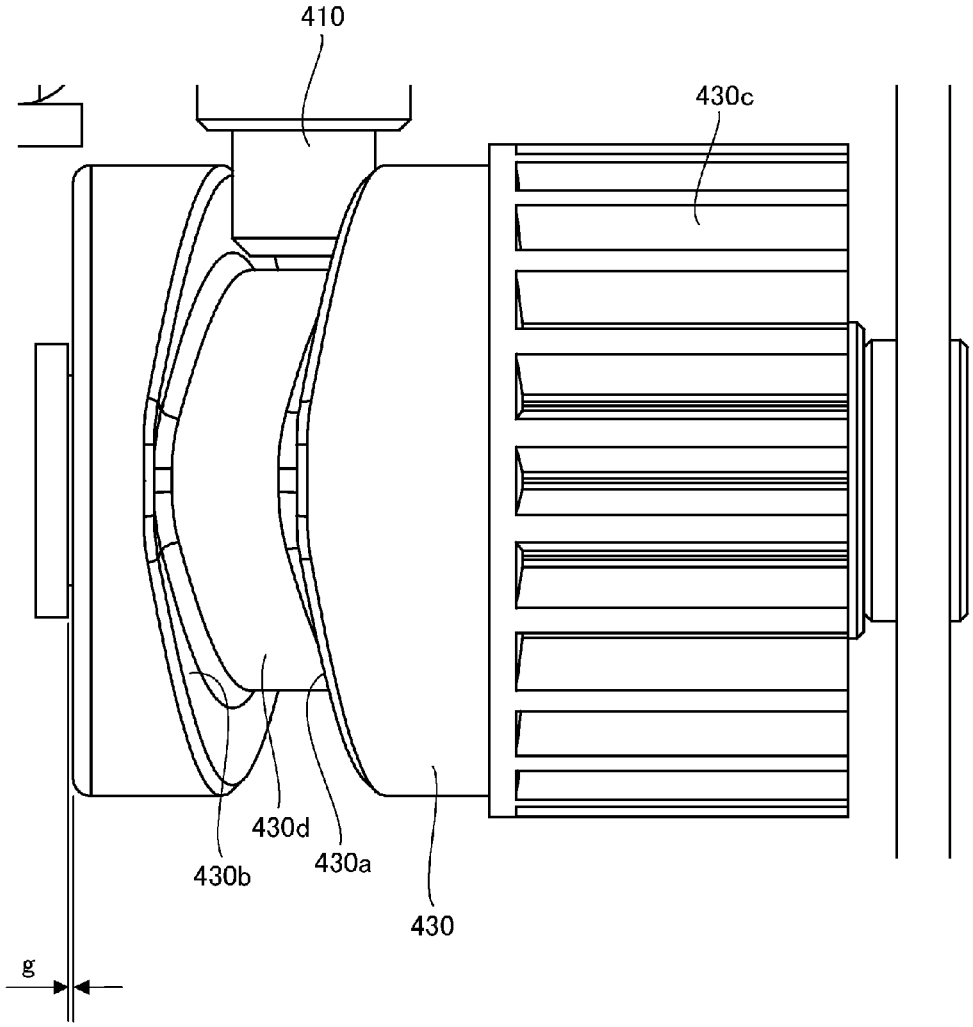
FIG. 11 is an enlarged view of the reciprocating mechanism illustrating a mounting play of a reciprocating cam.

Referring first to FIGS. 10 and 11, the stagnation of the reciprocating operation at the time when the moving direction of the heating unit 27A switches will be described. FIG. 10 schematically shows a movement locus of the reciprocating shaft 410 in the neighborhood of a reversing point (moving direction switching point) of the reciprocating operation, in the structure in which the reciprocating shaft 410 is engaged in the groove 430*d* of the reciprocating cam 430. As shown in FIG. 10, there is a small gap between the outer peripheral surface of the reciprocating shaft 410 and the inclined surfaces 430*a*, 430*b* of the groove 430*d*. In FIG. 10, the rotational moving direction of the reciprocating cam 430 is along an x-direction, and the moving direction of the heating unit 27A is along a y-direction.

When the groove 430*d* moves to the left (−x direction) in FIG. 10 by the rotation of the reciprocating cam 430, the reciprocating shaft 410 is pushed by the inclined surface 430*a* of the groove 430*d* to move in the +y direction in FIG. 10. With the continuing rotation of the reciprocating cam 430, it reaches the reversing point of the reciprocation, and the reciprocating shaft 410 is pushed by the inclined surface 430*b* of the groove 430*d*. Therefore, at the reversing point of the reciprocation, the surface to which the reciprocating shaft 410 contacts changes between the inclined surface 430*a* and the inclined surface 430*b* (changing region). In such a region, the reciprocating shaft 410 is not pushed by either of the inclined surfaces 430*a*, 430*b*, and therefore, the movement of the heating unit 27A, more particularly, the displacement of the reciprocating shaft 410 in the y direction stagnates. In other words, in such a region, the reciprocating shaft 410 does not move even if the reciprocating cam 430 rotates, and therefore, the reciprocating operation of the heating unit 27A does not occur.

Furthermore, as shown in FIG. 11, there exists play (gap g) which is necessary for the engagement, in a rotation center axis direction. As described hereinbefore, at the reversing point, the surface of the reciprocating cam 430 pushing the reciprocating shaft 410 switches. At this time, the direction of a component force (y) of a force received by the reciprocating cam 430 from the reciprocating shaft 410 (a reaction force of pushing the reciprocating shaft 410 by the inclined surface of the groove 430*d*) is reversed. That is, the surface of the reciprocating shaft 410 pushing the reciprocating cam 430 switches with the result of switching of the play killing direction. During the play killing motion, the reciprocating cam 430 per se is moved by the reaction to the reciprocating shaft 410, and therefore, displacement of the reciprocating shaft 410 (y direction) stagnates.

As described in the foregoing, the reciprocating operation of the reciprocating shaft 410 may stagnate at the fold-back point because of the play. The stagnation deteriorates the intended edge-flaw-suppressing effect of reciprocation at the end portions of the reciprocation range.

In this embodiment, in the predetermined range in which the contacted surface is switched and the play is being killed, the reciprocation end portion speed-up control is carried out. By the control of the controller 460, the movement distance between the reciprocating cam 430 and the reciprocating shaft 410 per predetermined number of the recording materials is larger in the above-described predetermined range than the other range (central region of the reciprocation region). In this embodiment, the amount of rotation of the reciprocating cam 430 per one recording material is made larger. As described, when the predetermined number is plural, the relative movement distance per the number of the recording materials is made larger within a predetermined range. The above-described range is preferably the region in which the surface switching and the play killing is carried out, but may be smaller or larger than that. It will suffice if the predetermined range covers at least a part of the range in which the reciprocating operation stagnates.

Such a predetermined range is discriminated from the detection result of the above-described position sensor 450. More particularly, the end portion of the reciprocating operation is detected using the sensor flag 440 and the position sensor 450. This will be described. The controller 460 comprises a counter C for counting a position in the reciprocation. The counter C resets the count to zero, when the sensor flag 440 starts to block the light from the position sensor 450 or when the sensor flag 440 starts to let the light pass. The count increments by 1 by one forward or backward movement (in one direction) for one passing of one recording material through the nip N.

First, the heating unit 27A moves in the direction from the front side to the rear side of the image forming apparatus, and the light from the position detecting sensor 450 is blocked (HP position) by the sensor flag 440, and then the count of the counter C is reset to zero. During the time in which the heating unit 27A is moving in the same direction, the sensor flag 440 keeps blocking the light from the position sensor 450.

Subsequently, the predetermined number of the recording materials pass through the nip N, a free end of the sensor flag 440 passes by the position sensor 450 by way of the reversing point in the rear side, and the light receiving portion of the position sensor 450 starts to receive the light from the light emitting portion. At this time, the count is Nr. Here, the count of the counter C is reset to zero. With further passing of the recording material through the nip N, the sensor flag 440 continues to move in the state that the light of the position sensor 450 is not blocked. Thereafter, the sensor flag 440 again blocks the light from the position sensor 450 by way of the front side reversing point. The count of the counter C at this time is Nf.

The groove 430*d* of the reciprocating cam 430 displaces in a constant y direction by the rotation of the reciprocating cam 430. That is, for one unidirectional movement of the reciprocating operation, the reciprocating cam 430 rotates through a predetermined amount relative to the reciprocating shaft 410. The movement is determined by the number of the pulses of the motor M2, and one movement is carried out by feeding a predetermined number of pulses to the motor M2.

Therefore, the number of the movements of the heating unit 27A in the forward stroke in the reciprocation is the same as that in the backward stroke, and the count at the fold-back point is as follows: Nr/2 for the rear side reversing point, and Nf/2 for the front side reversing point. Therefore, the controller 460 can discriminate the positions of the reciprocation end portion, and therefore, the above-described predetermined range) using the counter C.

In this embodiment, therefore, the end portion speed-up control is carried out using the count at the reversing point of the reciprocating operation. First, the comparison is made between the count at the reversing point and the current count. When the current count comes as close to the count at the reversing point as the reversing point count minus 3, the end portion speed-up control is started.

In this embodiment, the speed-up control is such that the normal moving operation is carried out twice for one recording material. In the range outside the above-described predetermined ranges, one unidirectional movement of reciprocation is effected for one recording material, but in the above-described predetermined range, two unidirectional movements of reciprocation are intermittently effected per recording material. In other words, in this embodiment, the number of the pulses supplied to the motor M2 per one recording material is increased. As a result, the rotation amount of the reciprocating cam 430 per one recording material is larger in the above-described predetermined ranges than in the other range of the reciprocation. In this embodiment, the count is incremented by two by one recording material in the above-described predetermined range.

When the current count reaches the reversing point count plus 2, the speed-up control is stopped to effect the normal reciprocation control. That is, one movement is effected per one recording material. With such control, the stagnation time at the reciprocation end portion can be reduced as compared with the case of normal movement. For example, it is assumed that the stagnation region can be passed by passing of 6 recording materials with the normal movement control. Using the above-described end portion speed-up control, the stagnation region can be passed by passing of 3 recording materials. It is possible to modify the speed-up control such that the stagnation region can be passed by one recording material.

Figure 12:
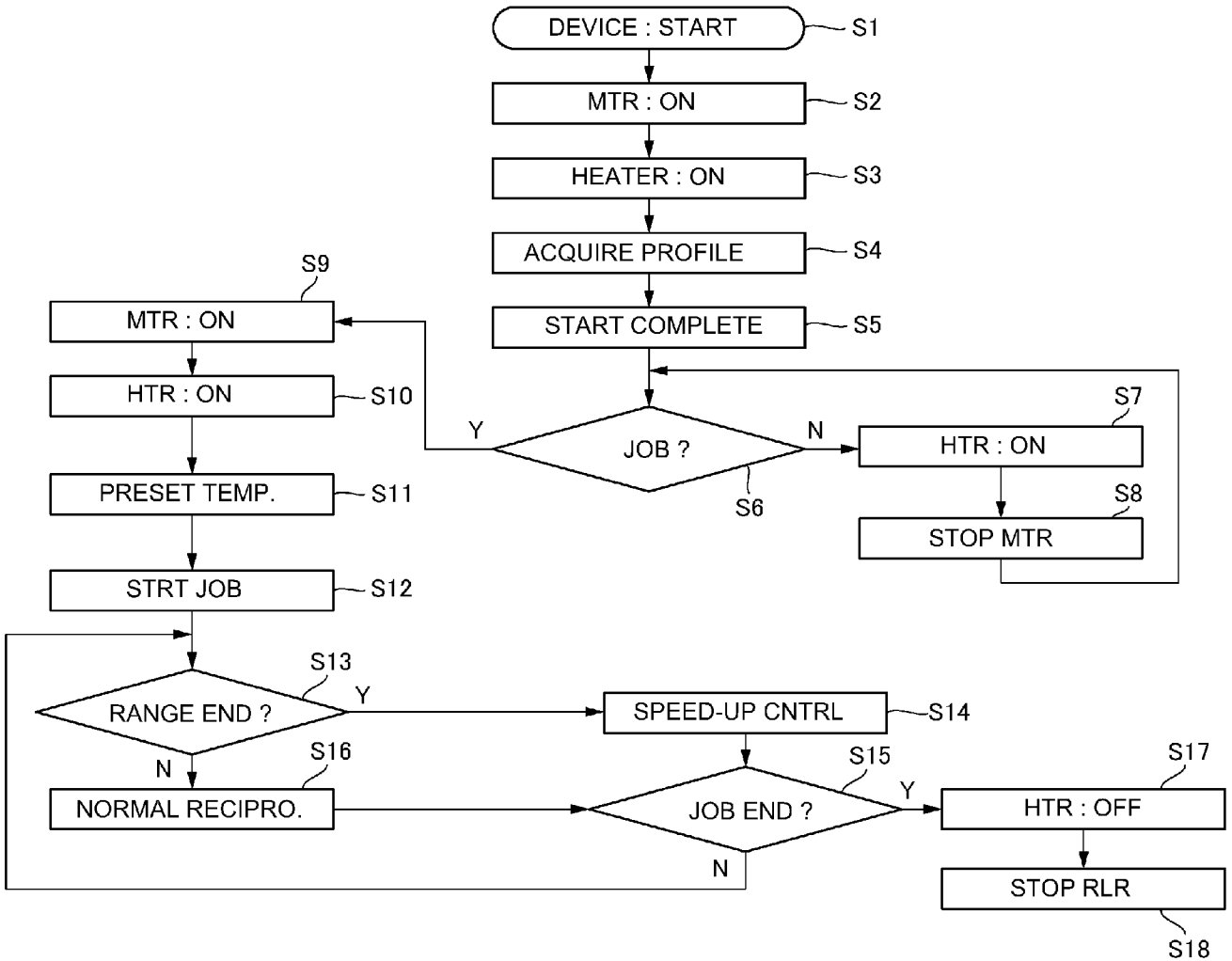
FIG. 12 is a flow chart showing an example of a control flow for the fixing device.

Referring to FIG. 12, such an example of control of this embodiment will be described. First, the main switch of the device is actuated, and the start-up of the fixing device 27 begins (S1), and the motor M1 for the pressing roller 304 starts (S2). Then, the electric power supply to the heater 300 for the heating belt 302 is started (S3). During the start-up operation for the fixing device, a reciprocation profile is acquired (S4).

The acquisition of the reciprocation profile is effected by detecting the position of end portion of the reciprocation by one reciprocation of the heating unit 27A by rotating the reciprocating cam 430. That is, the counts at reversing points of the reciprocation are acquired. The acquisition of the reciprocation profile is fundamentally carried out when the device is renewed such as when the fixing device is exchanged, but in this embodiment, it is carried out also upon the actuation of the main switch. Once the reciprocation profile is acquired, a step acquisition step may be omitted until the renewal of the device. By carrying out the acquisition of the reciprocation profile, the reciprocation end portion speed-up control can be carried out from the initial stage of start-up of the fixing device. The counter is operated at all times during the reciprocating operation since the counts at the reversing points are always renewed.

After completion of the start-up of the fixing device and the acquisition of the reciprocation profile (S5), the discrimination is made as to whether or not a job (JOB) is produced (S6). If not, the rotation of the motor M2 for the pressing roller 304 is stopped (S8), while keeping the electric power supply to the heater 300 ON, and waits for the production of the job (S7).

If a job is produced in step S6, the motor M2 of the pressing roller 304 is rotated (S9), and a heater 300 is supplied with the electric power (S10). When the temperature of the heating belt 302 reaches a predetermined target temperature (S11), the job is executed (S12). Then, the discrimination is made as to whether or not the current count of the counter C indicates the reciprocation end portion (S13). If so, the reciprocation end portion speed-up control is executed (S14). Thereafter, the discrimination is made as to whether or not the job is completed (S15), and if not, the operation returns to step S13. If the discrimination at step S13 does not indicate the reciprocation end portion, the normal movement stroke is carried out (S16), and the operation goes to step S15. If the discrimination as step S15 indicates the completion of the job, the electric power supply to the heater 300 is rendered OFF (S17), and the rotation of the motor M1 for the pressing roller 304 is stopped (S18).

Figure 13:
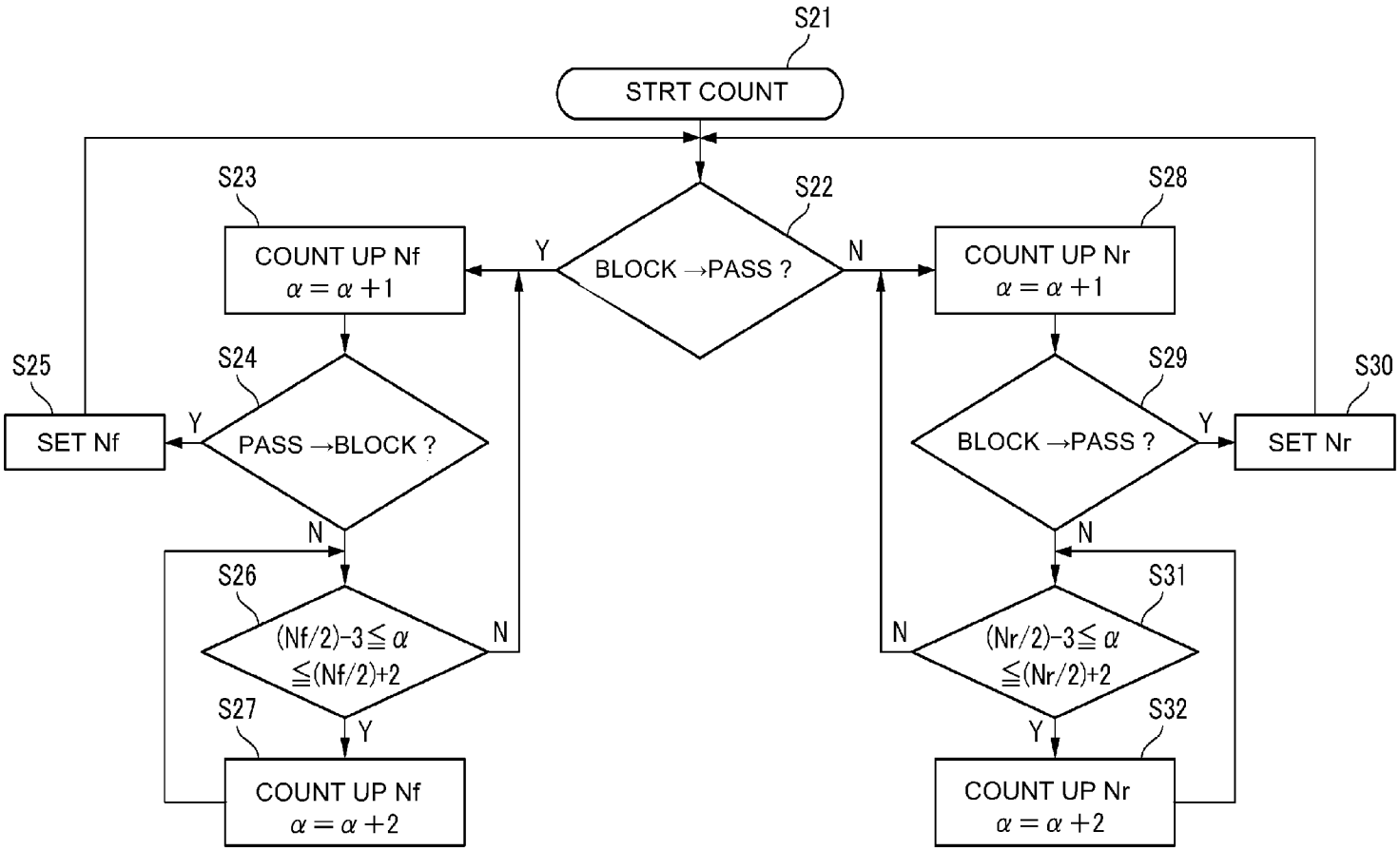
FIG. 13 is a flow chart illustrating a relation between a detection state of a position sensor and a count of a pulse counter in a control flow for the fixing device.

Referring to FIG. 13, a flow of control based on the count of counter C will be described. When the main switch of the device is actuated, the acquisition of the reciprocation profile is started, and the count operation of the counter C is started (S21). At this time, the discrimination is made as to whether or not the position sensor 450 changes from the light blocking state to the light passing state (S22). If so, it is discriminated that the heating unit 27A is moving from the rear side to the front side of the device. The count $\alpha$ of the counter C is incremented by one per one recording material (S23). Here, the count is Nf. Then, the discrimination is made as to whether or not the position sensor 450 changes from the light passing state to the light blocking state (S24).

If the discrimination at the step S24 is affirmative (Y), the value Nf can be determined (S25). Thereafter, the operation returns to step S22. If the result of discrimination at step S24 is negative (N), the discrimination is made as to whether or not the count $\alpha$, is not less than $\{(Nf/2)-3\}$, and not more than $\{(Nf/2)+2\}$ (S26). The result of discrimination at step S26 is affirmative (Y), that is, the heating unit 27A is in the predetermined range in which the moving direction reverses, the count $\alpha$ of the counter C is incremented by two because of the above-described two actuations of the reciprocating operation (S27). That is, the reciprocation end portion speed-up control is carried out. If the result of discrimination at step S26 is negative (N), the operation returns to step S23.

On the other hand, if the result of discrimination at step S22 is negative (N), that is, the position sensor 450 changes from the light passing state to the light blocking state, it is discriminated that the heating unit 27A is moving from the front side to the rear side of the device. The count α of the counter C is incremented by one per one recording material (S28). Here, the count is Nr. Then, the discrimination is made as to whether or not the state of the position sensor 450 changes from the light blocking state to the light passing state (S29).

If the discrimination at the step S29 is affirmative (Y), the value Nr can be determined (S30). Thereafter, the operation returns to step S22. If the result of discrimination at step S29 is negative (N), the discrimination is made as to whether or not the count α, is not less than {(Nr/2)−3}, and not more than {(Nr/2)+2} (S31). If the result of discrimination at step S31 is affirmative (Y), that is, the heating unit 27A is in the predetermined range in which the moving direction reverses, the count α of the counter C is incremented by two because of the above-described two actuations of the reciprocating operation (S32). That is, the reciprocation end portion speed-up control is carried out. If the result of discrimination at step S31 is negative (N), the operation returns to step S28.

Thus, in above-described flow of the control, either of the Nr or the Nf is incremented, depending on whether the state of the position sensor changes from the light blocking state to the light passing state or it changes from the light passing state to the light blocking state. In addition, the increment is either one or two, depending on whether or not the device is in the reciprocation end portion. The above-described flow chart is an example, and the discrimination criteria and the executing operations are not inevitable.

In this embodiment, as described above, the heating unit 27A is moved (a part of reciprocating operation) for each passage of a predetermined number of the recording materials through the nip. Therefore, the lateral edges of the recording materials do not pass the same portions of the nip N, and the surface of the heating belt 302 is protected from the deleterious effects of an edge flaw.

In addition, in this embodiment, the relative movement is caused between the reciprocating cam 430 and the reciprocating shaft 410 to move the heating unit 27A by the engagement between the reciprocating shaft 410 and the pair of inclined surfaces 430*a*, 430*b* of the reciprocating cam 430 to effect the reciprocation movement in a long term. Therefore, no spring or the like is required in order to move the heating unit 27A. Therefore, the motor is not required to drive the cam against an urging force of the spring, and the torque required for the rotation of the cam 430 may be relatively small, thus permitting the use of a reciprocating mechanism extending over a small space.

In addition, in the predetermined range where the moving direction of the heating unit 27A switches (reciprocation), the relative movement distance between the reciprocating cam 430 and the reciprocating shaft 410 per one recording material is made larger than in the other region. That is, the reciprocation end portion speed-up control is executed. Therefore, the stagnation of the operation of the heating unit 27A can be reduced where the moving direction switches. As a result, the production of the edge flaw can be reduced in the end portions of the reciprocation.

Figure 14:
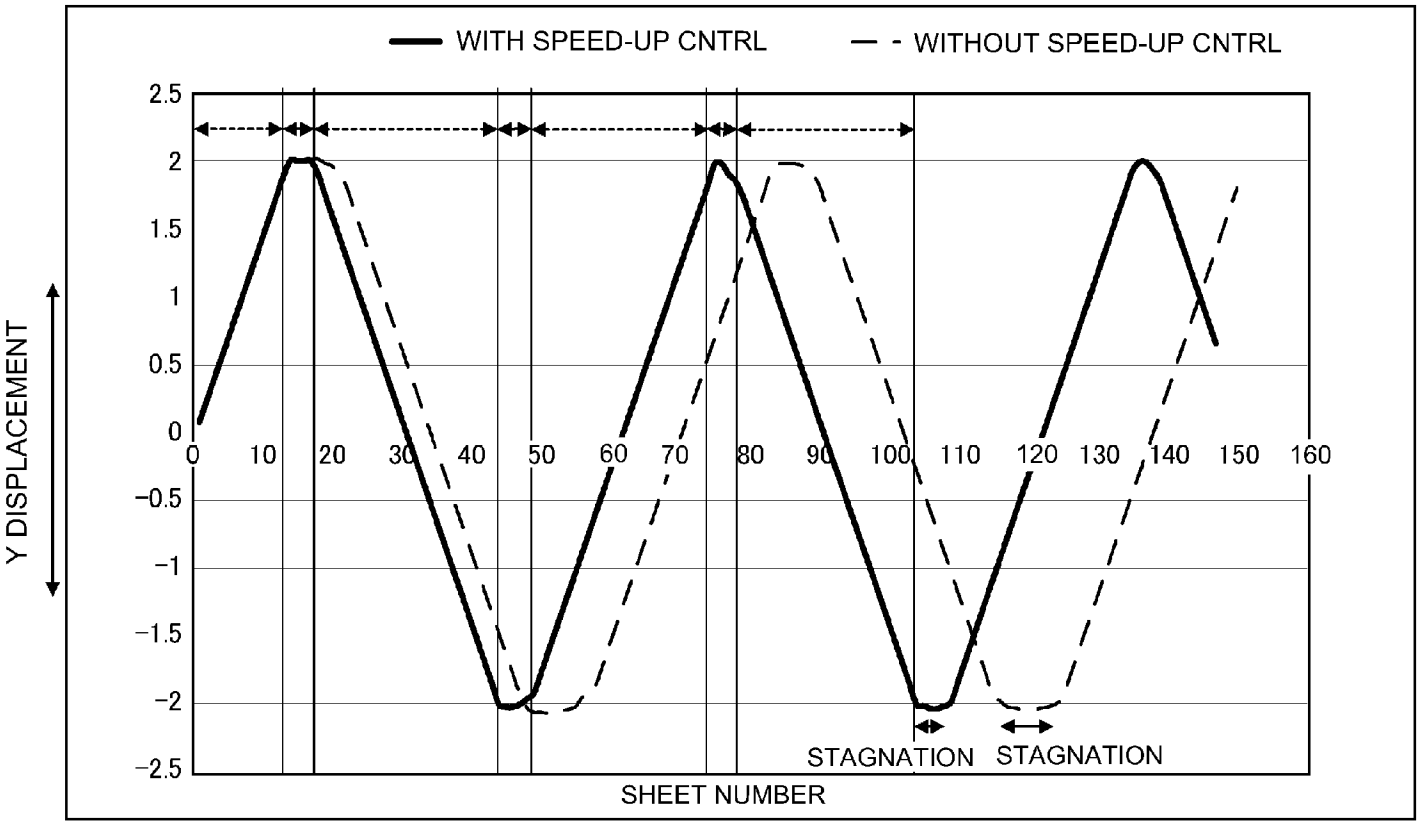
FIG. 14 shows relations between a number of passages and a reciprocation displacement when a speed-up control of the reciprocation is carried out and not.

FIG. 14 shows the results of experiments to check the effects of this embodiment. The experiments determined the relation between the number of passages of the recording material and the reciprocation displacement (y direction displacement) when the reciprocation end portion speed-up control of this embodiment is carried out and when it is not carried out. In FIG. 14, the solid line represents the case in which the reciprocation end portion speed-up control is carried out, and the broken line represents the case in which the reciprocation end portion speed-up control is not carried out. The left part of this graph indicated by the broken line double head arrow at the bottom represents the range in which one actuation of the reciprocation control is performed in the case of the reciprocation end portion speed-up control. The part of this graph indicated by the solid line double head arrow at the bottom represents the range in which two actuations of the reciprocation control are performed in the case in of the reciprocation end portion speed-up control. As indicated at the top of this graph, the left half shows the case in which the reciprocation end portion speed-up control is executed, and the right half shows the case in which it is not carried out.

As will be understood from FIG. 14, the motion (y direction) stagnates in the neighborhood of the reversing point of the reciprocating motion without the reciprocation end portion speed-up control (right half), but the stagnation is reduced when the reciprocation end portion speed-up control is carried out.

According to this embodiment, as described in the foregoing, the edge flaw of heating belt 302 is reduced, and therefore, the image quality and the lifetime can be improved, without upsizing the device.

Other Embodiments

The present invention is not limited to the foregoing embodiment. In the above-described embodiment, the fixing device is an on-demand type fixing device using a film-like heating belt as the rotatable heating member. In the above-described embodiment, the fixing device is an on-demand type fixing device using a film-like heating belt as the rotatable heating member. The heating mechanism in the foregoing embodiment is a ceramic heater, but it may be a halogen heater, or an induction heating mechanism using an excitation coil (IH).

The positional relation between the sensor flag and the position sensor may be the opposite. More particularly, the position sensor may be provided on the reciprocation movement side, and the sensor flag is provided on the non-reciprocation side. The means for detecting the position of the heating unit with respect to the widthwise direction may be the combination of the sensor flag and the position sensor, or may use an encoder. For example, an encoder is provided on the rotation shaft of the motor, and the rotation amount of the encoder is counted, and the home position can be made detected, by which the position of the heating unit from the home position can be detected. It will suffice if the position of the heating unit with respect to the widthwise direction can be detected.

The reciprocating mechanism has used the cam and the shaft in the foregoing, but another structure is usable. For example, the inclination member may be a screw shaft having an outer peripheral surface male screw, and the engageable member may be a nut screwed on the screw shaft. In this case, the fixing device is reciprocated by rotating the motor in forward and backward directions. It will suffice if the reciprocation movement can be carried out. Using a screw mechanism, the stagnation phenomenon-occurs at the point where the moving direction switches, due to the backlash, In the foregoing embodiments, two actuations of the reciprocating operation are carried out at the end portion, but the number may be three or more, as long as the number is larger than in the normal range.

The reciprocation end portion speed-up control may be carried out by another method. For example, the relative moving speed between the inclination member and the engageable member per one recording material is increased in the predetermined reciprocation end portion range. Specifically, the frequency of the motor for the reciprocating operation is increased in the predetermined end ranges. The speed in the end ranges may be twice of thrice. In the foregoing embodiments, the counts for the reciprocation end portion speed-up control are the counts at the reversing points minus 3 and plus 2, but the value may be changed taking into account the actual play between the inclined surface of the cam groove and the shaft, and the mounting play of the reciprocating cam per se.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195672/2012 filed Sep. 6, 2012, which is hereby incorporated by reference.

What is claimed is:

1. A fixing device comprising:

a fixing device including a pair of rotatable members which form a nip therebetween to fix a toner image on a sheet;

a reciprocating mechanism, including a motor, configured to reciprocate said fixing device within a predetermined range by moving the fixing device in a longitudinal direction thereof for each passage of a predetermined number of sheets through the nip; and a controller configured to control said motor so that a drive time of said motor per the predetermined number of the sheets is longer in a first range including a point at which a moving direction of said fixing device reverses than in a second range in which the moving direction of said fixing device does not reverse.

2. A device according to claim 1, further comprising a counter configured to count the number of the sheets passing the nip, wherein said controller controls said motor on the basis of an output of said counter.

3. A device according to claim 1, wherein said controller drives said motor for a predetermined time for each passage of the predetermined number of sheets through the nip in the second range, and drives said motor for the predetermined time for each passage of the predetermined number of sheets through the nip and repeats such a drive of said motor in the first range.

4. A device according to claim 1, further comprising a sensor configured and positioned to detect a position of said fixing device in the longitudinal direction, wherein said controller controls said motor in accordance with an output of said sensor.

5. A device according to claim 1, wherein said reciprocating mechanism includes a cam and a cam follower driven by said cam, said cam and said cam follower being provided in a drive transmission path between the motor and said fixing device to reciprocate said fixing device by unidirectional rotation of said motor.

6. A device according to claim 1, wherein said controller moves said fixing device during the sheet being in the nip.

7. A control device for controlling a motor for reciprocating a fixing device in a longitudinal direction thereof, said fixing device including a fixing device having a pair of rotatable members which form a nip therebetween to fix a toner image on a sheet, said control device comprising:

a counter configured to count the a number of sheets passing through said fixing device; and a controller configured to control said motor for each passage of a predetermined number of sheets, on the basis of an output of said counter, said controller controlling said motor so that a drive time of said motor per the predetermined number of the sheets is longer in a first range including a point at which a moving direction of said fixing device reverses than in a second range in which the moving direction of said fixing device does not reverse.

8. A device according to claim 7, wherein said controller drives said motor for a predetermined time for each passage of the predetermined number of sheets through the nip in the second range, and drives said motor for the predetermined time for each passage of the predetermined number of sheets through the nip and repeats such a drive of said motor in the first range.

9. A device according to claim 7, further comprising a sensor configured and positioned to detect a position of said fixing device in the longitudinal direction, wherein said controller controls said motor in accordance with an output of said sensor.

10. A device according to claim 7, wherein said controller moves said fixing device during the sheet being in the nip.

11. A fixing device comprising:

a fixing device including a pair of rotatable members which form a nip therebetween to fix a toner image on a sheet;

a reciprocating mechanism, including a motor, configured to reciprocate said fixing device within a predetermined range by moving the fixing device in a longitudinal direction thereof for each passage of a predetermined number of sheets through the nip; and a controller configured to control said motor so that a drive time of said motor per the predetermined number of the sheets is longer in first ranges comprising predetermined boundary ranges than in a second range which is a middle range between said predetermined boundary ranges.

12. A device according to claim 11, further comprising a counter configured to count the number of the sheet passing the nip, wherein said controller controls said motor on the basis of an output of said counter.

13. A device according to claim 11, wherein said controller drives said motor for a predetermined time for each passage of the predetermined number of sheets through the nip in the second range, and drives said motor for the predetermined time for each passage of the predetermined number of sheets through the nip and repeats such a drive of said motor in the first ranges.

14. A device according to claim 11, further comprising a sensor configured and positioned to detect a position of said fixing device in the longitudinal direction, wherein said controller controls said motor in accordance with an output of said sensor.

15. A device according to claim 11, wherein said reciprocating mechanism includes a cam and a cam follower driven by said cam, said cam and said cam follower being provided in a drive transmission path between the motor and said fixing device to reciprocate said fixing device by unidirectional rotation of said motor.

16. A device according to claim 11, wherein said controller moves said fixing device during the sheet being in the nip.

17. A control device for controlling a motor for reciprocating a fixing device in a longitudinal direction thereof, said fixing device including a fixing device having a pair of rotatable members which form a nip therebetween to fix a toner image on a sheet, said control device comprising:

a counter configured to count the number of sheets passing through said fixing device; and a controller configured to control said motor for each passage of a predetermined number of sheets, on the basis of an output of said counter, wherein said controller controls said motor so that a drive time of said motor per the predetermined number of the sheets is longer in first ranges comprising predetermined boundary ranges than in a second range which is a middle range between said predetermined boundary ranges.

18. A device according to claim 17, wherein said controller drives said motor for a predetermined time for each passage of the predetermined number of sheets through the nip in the second range, and drives said motor for the predetermined time for each passage of the predetermined number of sheets through the nip and repeats such a drive of said motor in the first ranges.

19. A device according to claim 17, further comprising a sensor configured and positioned to detect a position of said fixing device in the longitudinal direction, wherein said controller controls said motor in accordance with an output of said sensor.

20. A device according to claim 17, wherein said controller moves said fixing device during the sheet being in the nip.

* * * * *